US006631931B2

(12) United States Patent
Magnusson

(10) Patent No.: US 6,631,931 B2
(45) Date of Patent: Oct. 14, 2003

(54) LOCK FOR A SWINGING DOOR

(75) Inventor: Claes Magnusson, London (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/969,822

(22) Filed: Oct. 4, 2001

(65) Prior Publication Data

US 2003/0067173 A1 Apr. 10, 2003

(51) Int. Cl.[7] ..... E05C 1/10
(52) U.S. Cl. ..... 292/175; 292/42; 292/164
(58) Field of Search ..... 292/42, 175, 164, 292/146, 147, 152, 153, 302, 342, DIG. 19, DIG. 31; 16/82

(56) References Cited

U.S. PATENT DOCUMENTS

| | | | | |
|---|---|---|---|---|
| 69,235 A | | 9/1867 | Messler | |
| 813,343 A | * | 2/1906 | Bartlett | |
| 1,058,952 A | | 4/1913 | Durner | |
| 1,687,388 A | | 10/1928 | Rigo | |
| 2,060,284 A | | 11/1936 | Curtis | |
| 2,431,105 A | | 11/1947 | Brinson | |
| 3,774,420 A | | 11/1973 | Orr | |
| 3,782,139 A | | 1/1974 | Rubner | |
| 3,909,051 A | * | 9/1975 | Nakai | 292/216 |
| 3,937,504 A | | 2/1976 | McElroy | |
| 4,440,428 A | * | 4/1984 | Jessup et al. | 292/251.5 |
| 5,174,617 A | * | 12/1992 | Huber et al. | 292/128 |
| 5,193,707 A | * | 3/1993 | Mizumura | 220/326 |
| 5,669,639 A | * | 9/1997 | Lawrence | 292/175 |
| 6,021,603 A | * | 2/2000 | Prete et al. | 49/183 |

FOREIGN PATENT DOCUMENTS

| | | |
|---|---|---|
| FR | 1383682 A | 11/1964 |
| GB | 2075586 A | 11/1981 |
| WO | 00/46473 A1 | 8/2000 |

* cited by examiner

*Primary Examiner*—Gary Estremsky
(74) *Attorney, Agent, or Firm*—Birch, Stewart, Kolasch & Birch, LLP

(57) ABSTRACT

A lock for a swinging door comprises a lock casing having a fore-end and at least a first side wall. A first bolt is spring-loaded for engagement with a stationary engagement member of a door case or the like and is movable between a locking position in which it does not extend beyond the fore-end, and an open position, in which it is retracted into the lock casing. The lock casing has an opening in its fore-end and its first side wall, said opening enabling engagement between the stationary engagement member and the first bolt in its locking position.

20 Claims, 11 Drawing Sheets

LOCK FOR A SWINGING DOOR

FIELD OF THE INVENTION

The present invention concerns a lock for a swinging door comprising a lock casing and a bolt spring-loaded for engagement with a stationary engagement member of a door case or the like.

BACKGROUND OF THE INVENTION

Normally, a lock has its bolt movable between a position extending outside a fore-end of the lock and an associated door leaf (locking position) and a position retracted to within the casing and the door leaf (open position). In certain applications, a lock having a bolt spring-loaded towards its open position may cause injury to people due to the protruding bolt. This is particularly the case in marine applications, where a ship or yacht is frequently exposed to movements of the sea that may cause unintentional and unexpected swinging movement of a door that is not properly locked or otherwise secured.

One object of the present invention is to provide a lock, particularly, but not exclusively for marine applications, that does expose people to injury risk due to a swinging door.

There is also a desire to enable keeping a door leaf in its open position, for instance a door between an exterior bath platform of a yacht and the interior of its hull. The spring loaded bolt of the lock locking the door in its closed position is normally utilized for this purpose by engaging—in the open position of the door—a fixed engagement member.

In certain applications, however, the angle of the door leaf in its open position is such that the bolt is not readily engageable with this engagement member. A further object of the present invention is to provide a lock—with or without a normal protruding spring loaded latch bolt—that is not sensitive to the angle of a door leaf in an open position as regards keeping the door in such open position.

A further object of the present invention is to provide a lock that is readily adaptable to different thickness of door leaves.

A still further object is to provide a lock, the handle of which is comfortably accessible and operable even when a relatively thin door leaf is concerned.

SUMMARY OF THE INVENTION

In order to fulfil the objects stated above, the present invention provides a lock for a swinging door comprising a lock casing having a fore-end and at least one side-wall, at least one bolt spring-loaded for engagement with a stationary engagement member of a door case or the like, said at least one bolt being movable between a locking position in which said bolt does not extend beyond said fore-end, and an open position, in which said bolt is retracted into said lock casing, said lock casing having an opening in its fore-end and said at least one side wall, said opening enabling engagement between said stationary engagement member and said bolt in said locking position thereof.

BRIEF DESCRIPTION OF THE DRAWINGS

Further scope of applicability of the present invention will become apparent from the detailed description given hereafter. However, it should be understood that the detailed description and specific examples, while indicating preferred embodiments of the invention, are given by way of illustration only, since various changes and modifications within the spirit and scope of the invention will become apparent to those skilled in the art from this detailed description, wherein.

DETAILED DESCRIPTION OF THE PREFERRED EMBODIMENTS

Figure 1:
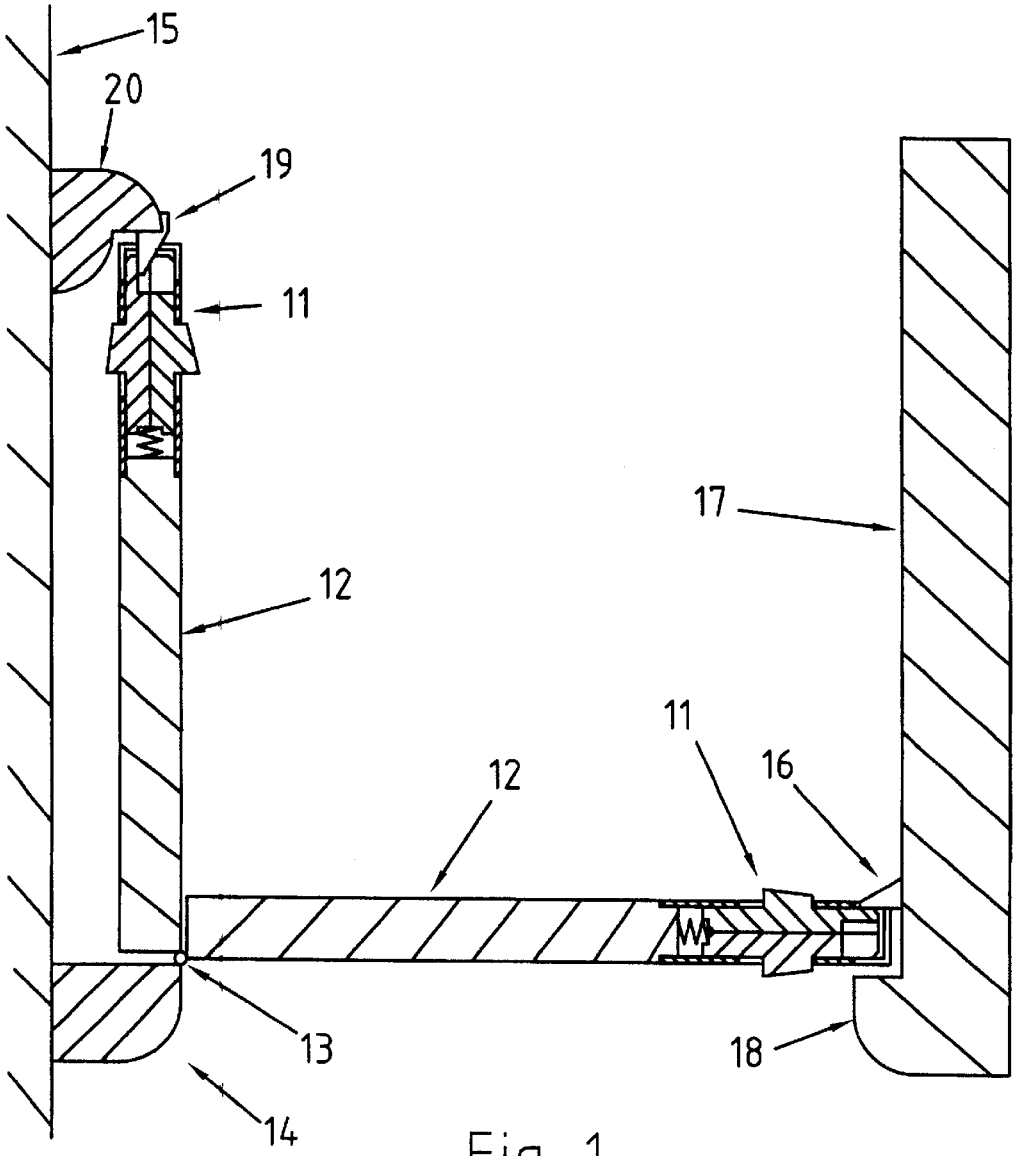
FIG. 1 is a schematic top view of a door in a locked position and an open and secured position using a lock according to a first embodiment of the present invention.

In the drawings, FIG. 1 illustrates a typical use of a lock 11 according to a first embodiment of the present invention mounted in a door leaf 12. The door leaf is swingable about a hinge 13 attached to a door post 14 mounted to a wall 15 between a first, closed position, and a second, open position. In the closed position, the lock engages a first stationary engagement member 16 mounted onto a wall 17 close to a door post 18 so as to prevent the door from opening. In the open position, the lock is shown to engage a second stationary engagement member 19 mounted onto a post 20 protruding from the wall 15 as an optional means to keep the door in the open position and to prevent uncontrolled swinging thereof.

Figure 2:
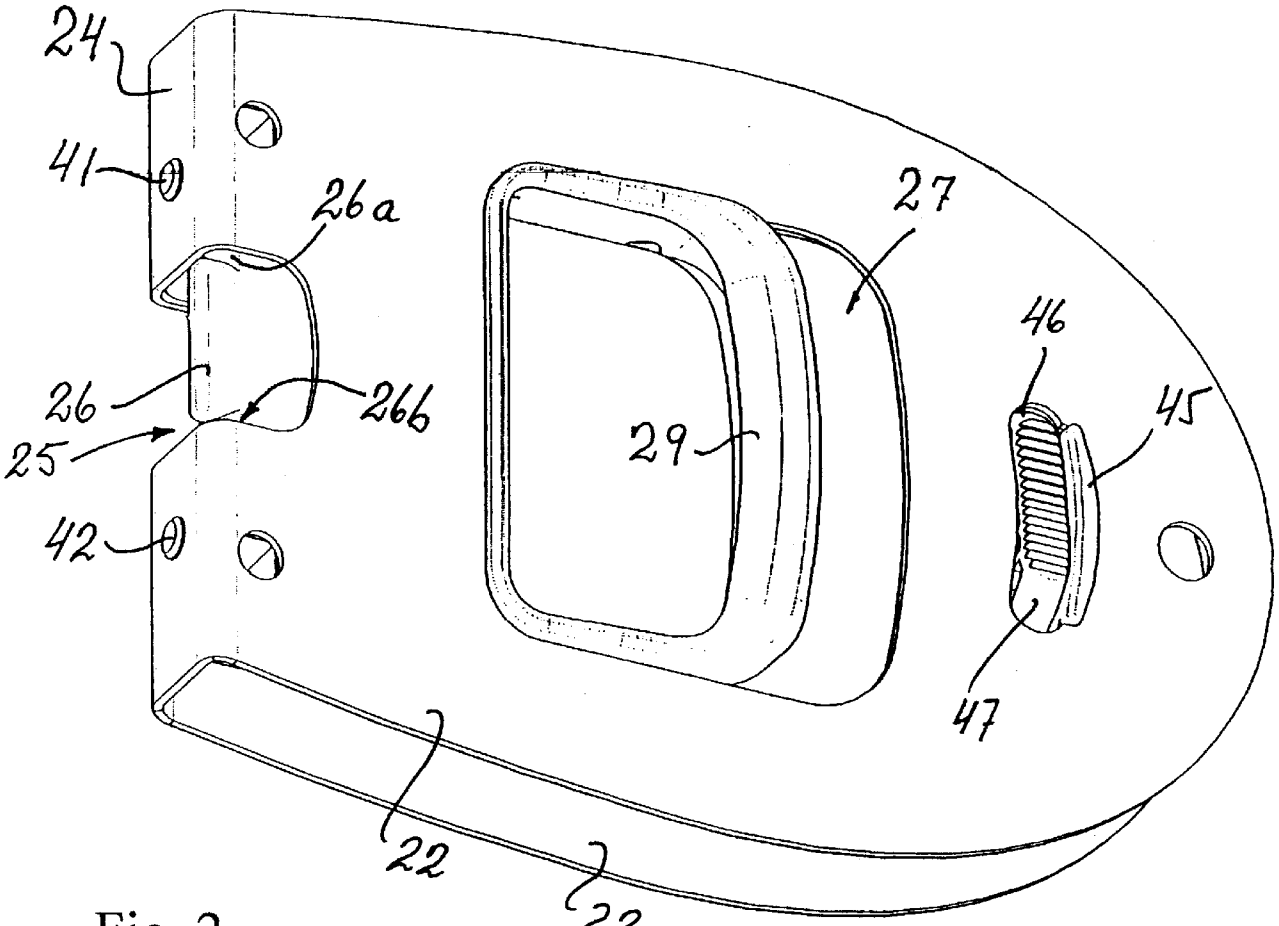
FIG. 2 is a perspective view from one side of a lock according to the embodiment of the invention shown in FIG. 1.
Figure 3:
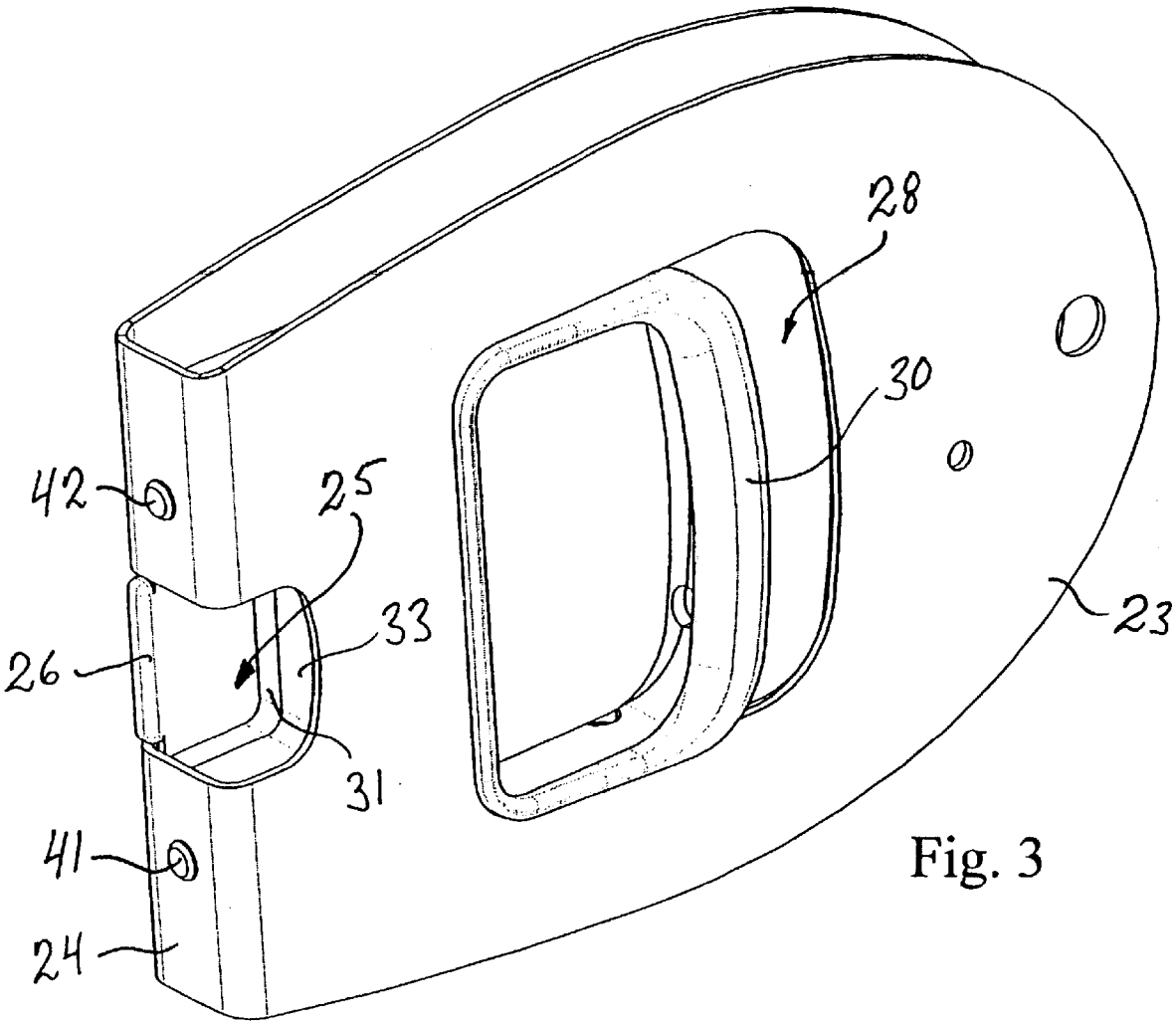
FIG. 3 is a perspective side from the opposite side of the lock according to FIG. 2.
Figure 4:
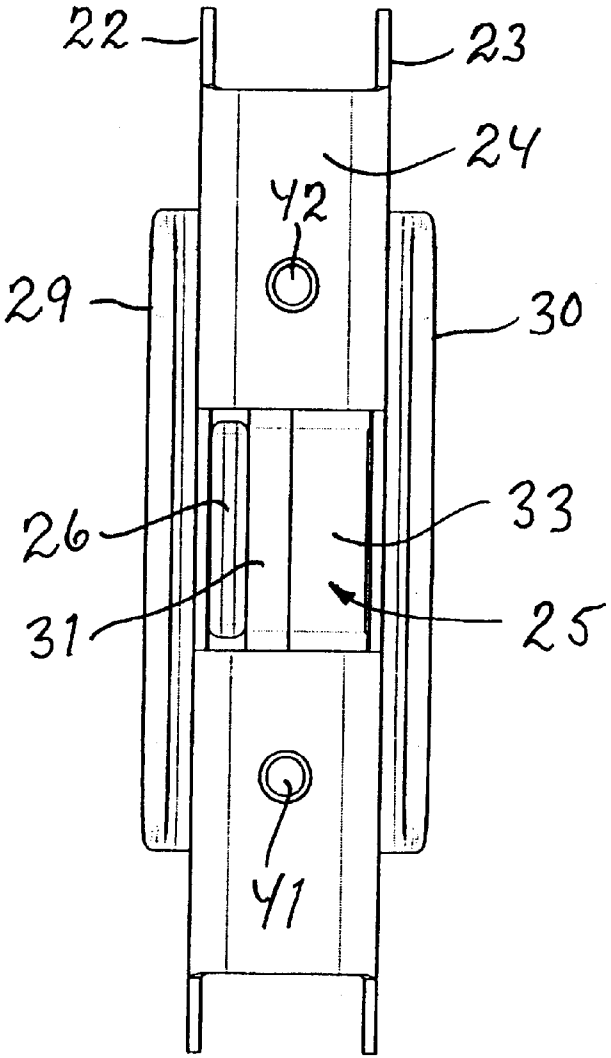
FIG. 4 is a view towards the fore-end of the lock as seen in FIG. 3.

The perspective views of FIGS. 2 and 3 as well as the front view of FIG. 4 reveal a lock case 21 having two opposed walls 22 and 23 and a front wall, or, fore-end 24 joining the opposed walls. The distance between the opposed walls defines the thickness of a door in which to mount the lock.

An opening 25 is provided in the fore-end and the opposed walls 22, 23. In certain applications, the opening may be provided in the fore-end and one of the walls only. In any case, the opening is provided to give access to a bolt 26 movable within the lock case between a locking position shown and a retracted, open position. Openings 27, 28 are provided in the opposed walls 22, 23, respectively, for a first and a second handle member 29, 30, respectively, for the manual operation of the bolt 26 by gripping with a hand into a respective opening 29', 30' in the handle members.

For a more detailed explanation of the structure of the lock according to the first embodiment of the present invention, reference is made to FIGS. 5–8.

Figure 5:
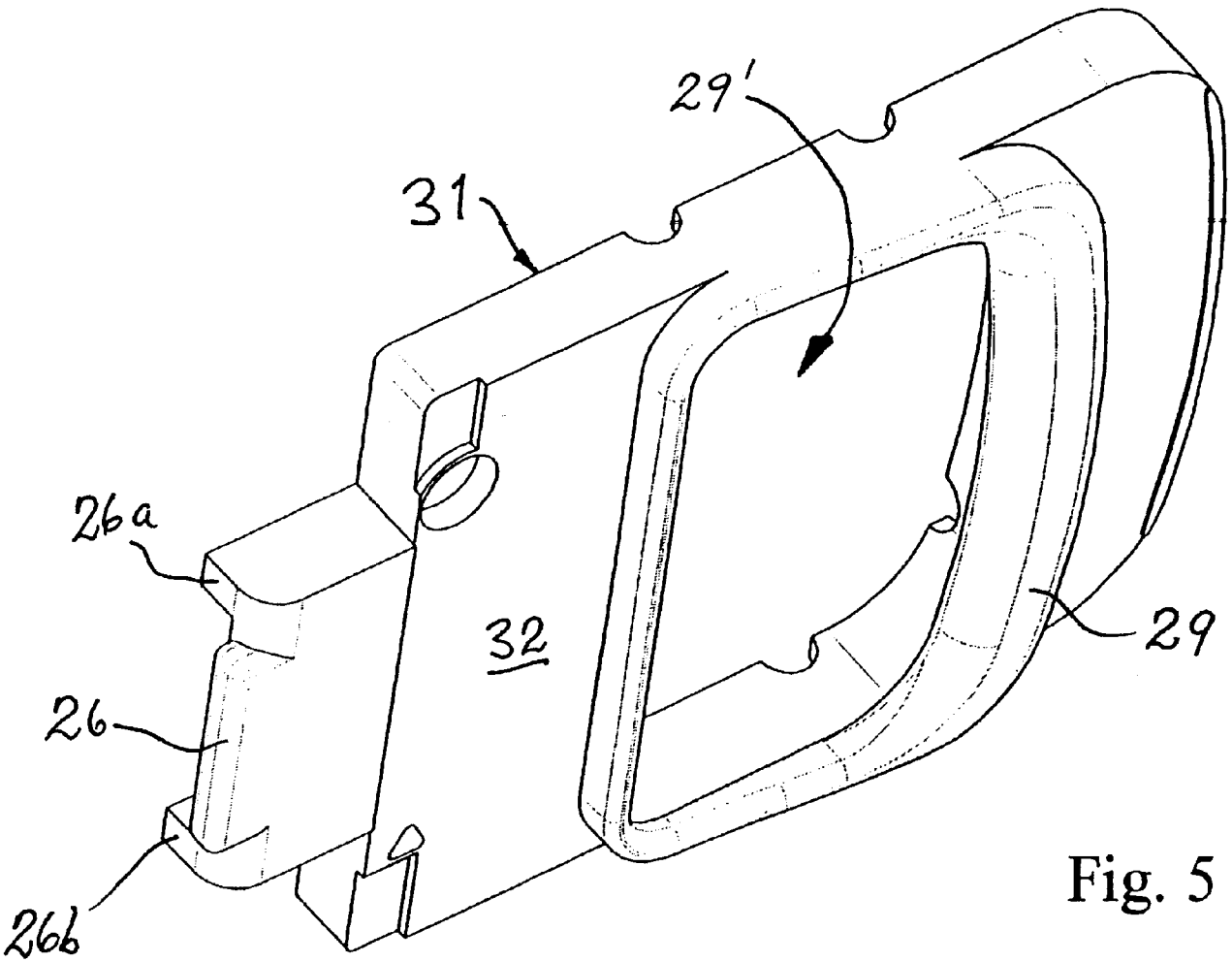
FIG. 5 is a perspective view of a combined bolt and first handle member of the lock according to FIGS. 2 and 3.

FIG. 5 shows the bolt 26 to be integral with the first handle member 29 in a first unitary block 31, preferably made of a moldable synthetic material. The block 31 has a generally flat surface 32 from which the first handle member rises so as to protrude through the opening 27 in the first side wall 22 as seen in FIG. 2.

Figure 6:
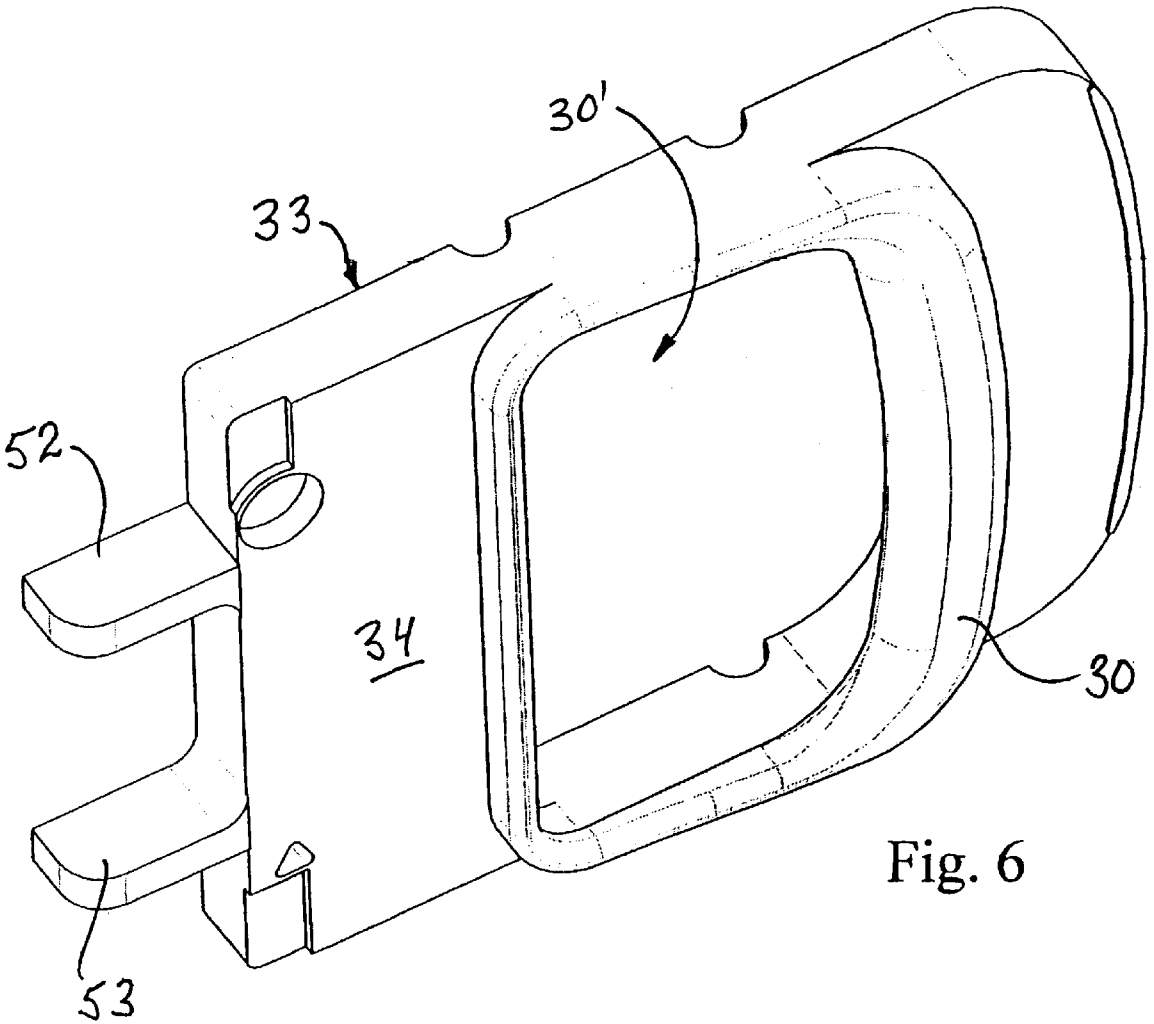
FIG. 6 is a perspective view of a second handle member of the lock according to FIGS. 2 and 3.

FIG. 6 shows a second unitary block 33, also preferably made of a moldable synthetic material, the second handle member 30 rising from a generally flat surface 34 thereof so as to protrude through the opening 28 in the second side wall 23 as seen in FIG. 3.

Figure 7:
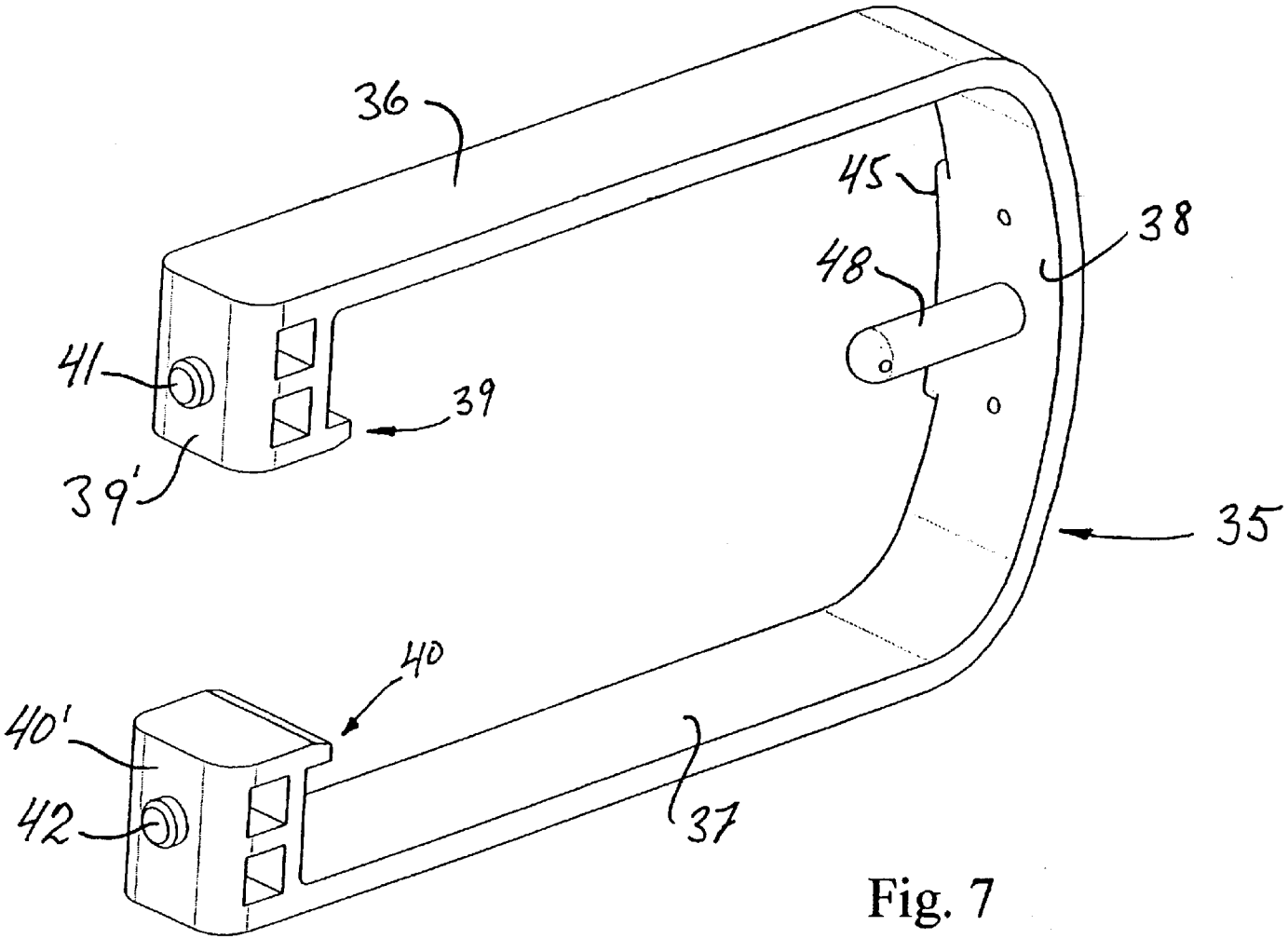
FIG. 7 is a perspective view of a guide member for guiding sliding movement of the assembled members of FIGS. 4 and 5.
Figure 8:
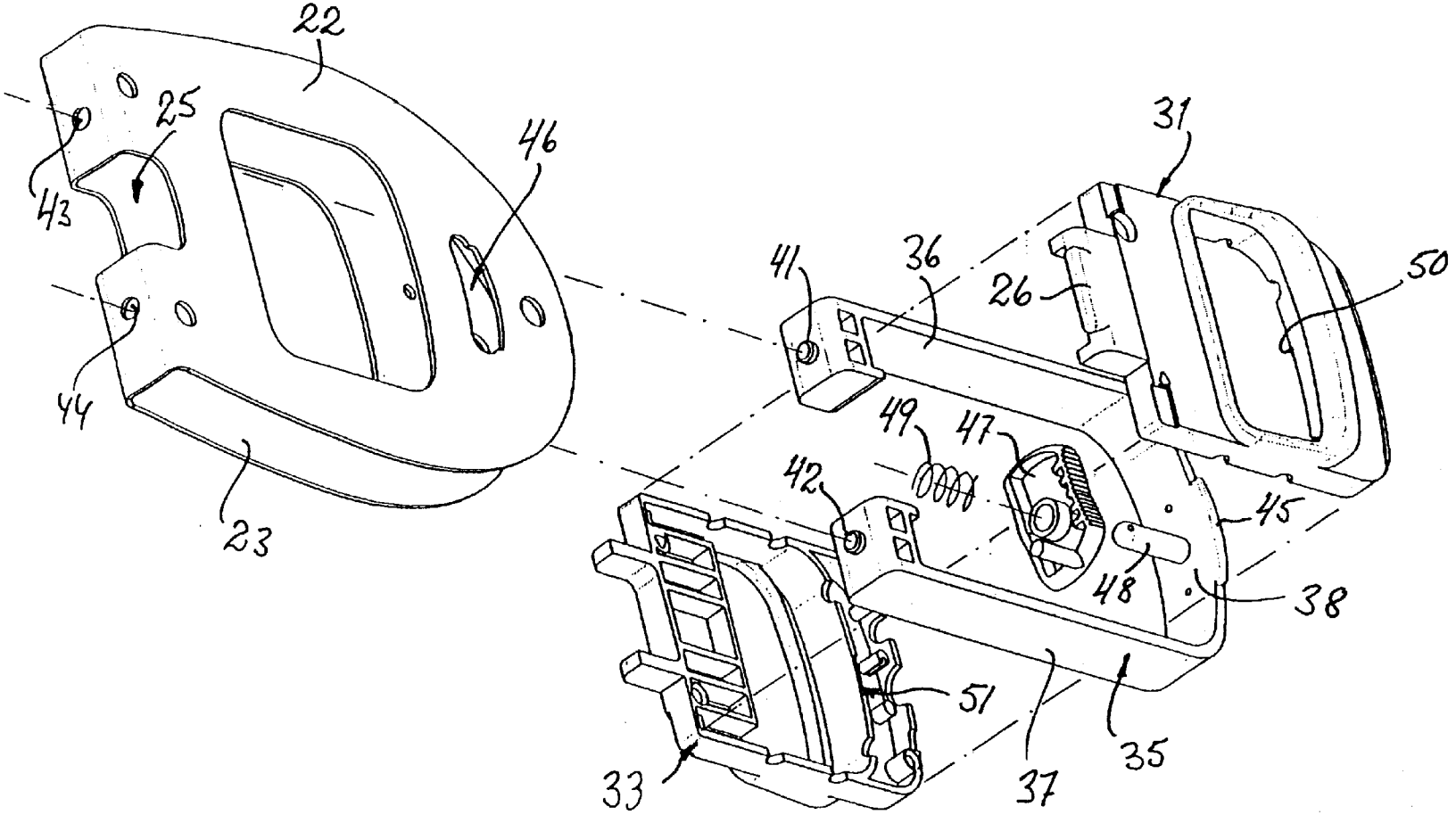
FIG. 8 is an exploded perspective view of the lock casing of the lock as seen in FIG. 2, the combined bolt and first handle member of FIG. 5, the second handle member of FIG. 6, and the guide member of FIG. 7, as well as a catch member.

FIG. 7 shows a guide frame 35 having a general U-shape with two parallel legs 36, 37 extending from a joining web portion 38. The legs have inwardly turned ends 39, 40, respectively. The guide frame, being preferably made of the same or a similar moldable material as the two blocks 31, 33, is insertable and fits between the opposed walls 22, 23 of the lock casing as indicated in FIG. 8. In its inserted position, bosses 41, 42 (FIG. 7) formed at the end surfaces 39', 40' of the inwardly turned ends 39, 40, respectively, extend through corresponding apertures 43, 44 (FIG. 8), respectively, made in the fore-end 24.

The two blocks 31, 33 are shaped to match one another so as to form together a unitary handle and bolt member by being brought together as indicated in FIG. 8 and inserted within the confines of the legs 36, 37 of the guide frame 35 as indicated by dash-dotted lines extending between the blocks 31, 33. In that position, the guide frame is introduced between the opposed walls 22, 23 of the lock casing as indicated by dash-dotted lines extending through the apertures 43, 44. In its final position with the bosses 41, 42 protruding through the apertures 43, 44, the guide frame is in a position where the bolt 26 is accessible through the opening 25 in the lock casing. A seen in FIGS. 7 and 8, the web portion 38 of the guide frame has a protrusion 45 on its side facing the side wall 22 of the lock casing. In the final position of the guide frame, this protrusion snaps into a corresponding aperture 46 in the wall 22 and, thus, keeps the guide frame in its correct position.

Evidently, the external dimensions of the guide frame define the size of a recess in a door in which to mount the lock.

In the embodiment shown, the lock is provided with an optional 'privacy latch' 47, i.e., a latch provided on the interior side of the lock to prevent intrusion. This latch is pivotally mounted on a trunnion 48 integrally protruding from the web portion 38 of the guide frame so as to be accessible through a correspondingly enlarged portion of the aperture 46 as seen in FIG. 2. The latch has a protruding pin 47'.

A coil spring 49 is mounted on the trunnion 48 outside the latch 47 and abuts backward interior walls 50, 51 of the assembled handle members 31, 32 so as to urge them and the bolt 26 towards the fore-end 24 of the lock, i.e., the locking position of the bolt. From this locking position, the bolt is manually retractable by operation of either of the handle members 29, 30. The sliding motion of the two blocks 31, 33 and the bolt 26 is guided by the inner surfaces of the opposed walls 22, 23 of the lock casing as well as by the opposed surfaces of the legs 36, 37 of the guide frame 35.

The protruding pin 47' of the privacy latch 47 is effective to either abut the assembled walls 50, 51 in its latching position, thereby preventing movement of the assembled handle members 29, 30 in their opening direction, or, pivoted to its free position, to pass through a hole 51' provided in the assembled walls 50, 51 to allow movement of the handle members in their opening direction.

Movement of the bolt 26 through the opening 25 in the lock casing is prevented by widened portions 26*a*, 26*b* thereof abutting the inner side of the fore-end 26 on either sides of the opening 25 as seen in FIGS. 2 and 3. The widened portions are rib-like and have the full thickness of the block 31 (except for the handle protrusion) as best seen in FIGS. 3 and 5, whereas the bolt has about half the thickness of the block 31 as best seen in FIG. 4. Consequently, the rib-like portions 26*a*, 26*b* serve as stiffeners for the bolt 26. To complete stiffening of the bolt, the second block 33 has corresponding rib-like protrusions 52, 53 as seen in FIG. 6.

The width of the bolt 26 with its widening portions 26*a*, 26*b* is adapted to the free width between the inwardly turned ends 39, 40 of the legs 36, 37 of the guide frame 35. This is true also for the total external width of the rib-like protrusions 52, 53.

Figures 9, 10:
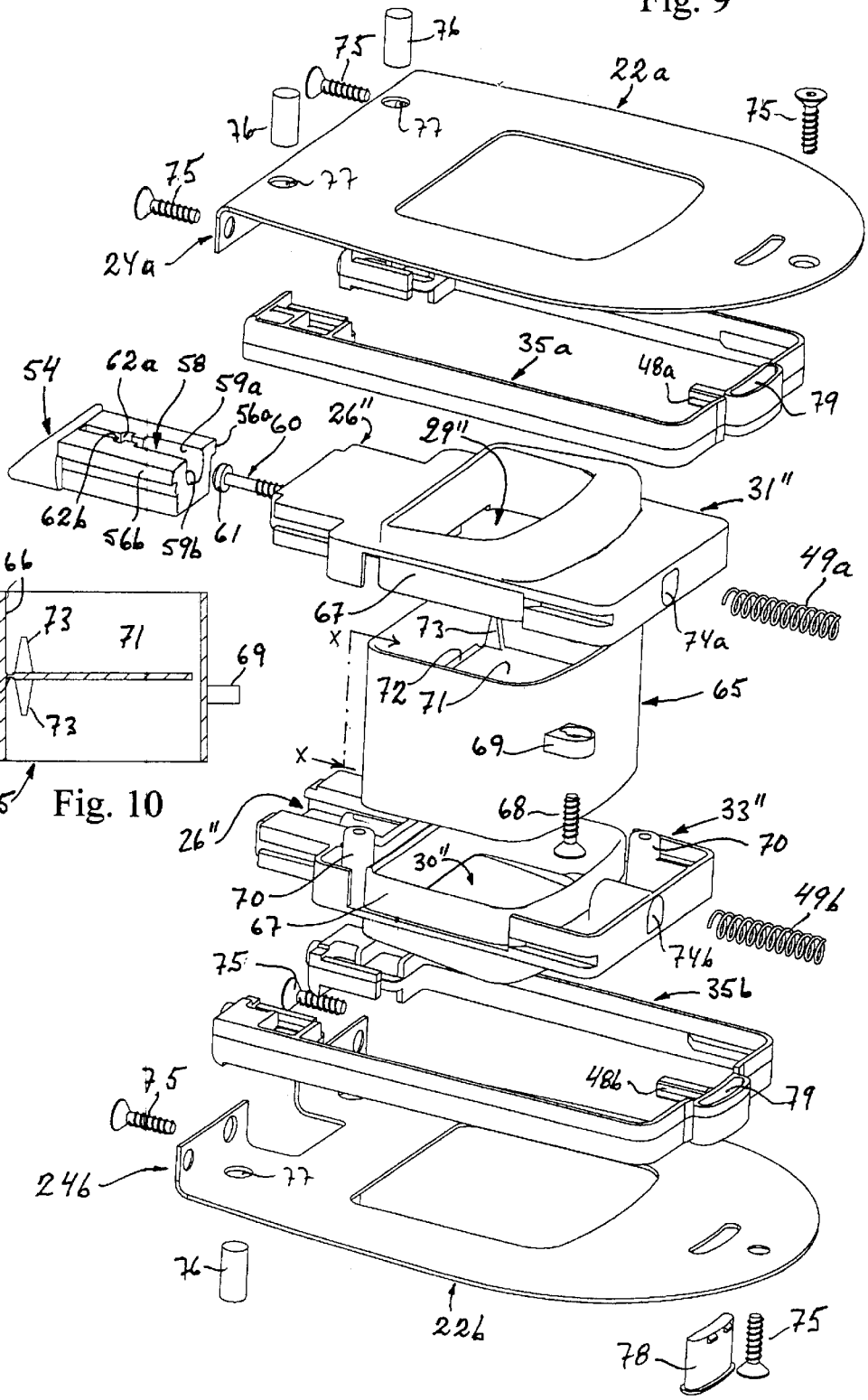
FIG. 9 is an exploded perspective view of a lock according to a second embodiment of the present invention looking towards the rear end of the lock.
FIG. 10 is a section through a door thickness adapter shown in FIG. 6 taken along line X—X.
Figure 11:
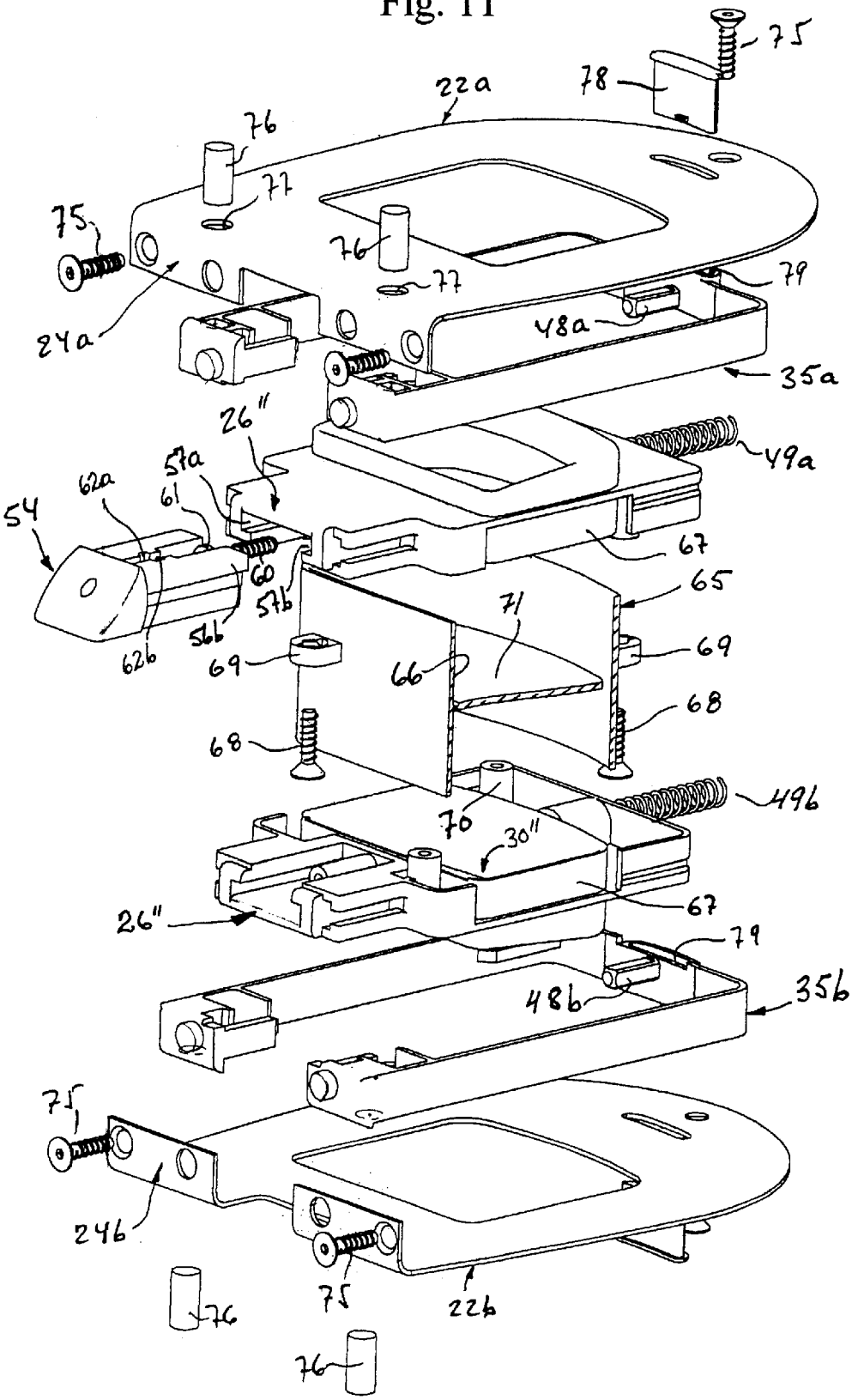
FIG. 11 is an exploded perspective view of the lock according to FIG. 9 looking towards the fore end of the lock.
Figures 12, 13:
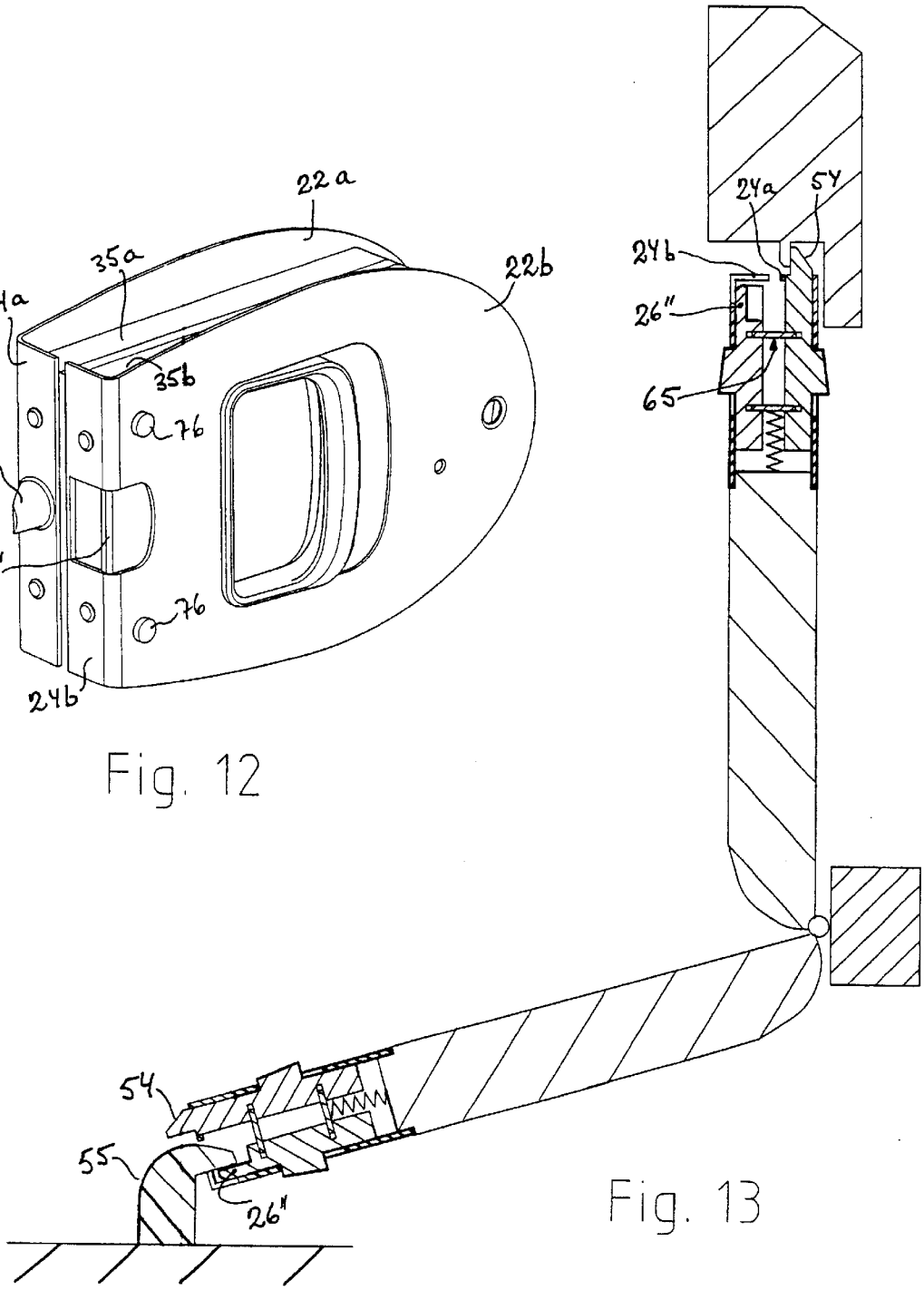
FIG. 12 is a perspective view of a complete lock according to FIGS. 9 and 11.
FIG. 13 is a top view showing the use of the second embodiment of the lock according to the present invention.

The second embodiment of the present invention is particularly shown in FIGS. 9, 11 and 12, wherein parts corresponding to parts of the first embodiment have been given the same reference numeral completed by a bis sign ("). In this embodiment, both blocks 31" and 33" are equal and are both provided with a bolt 26" as previously described. Furthermore, one block 31" is provided with a protruding, chamfered bolt 54. This embodiment is particularly intended for applications where there is a need for a protruding bolt in one position of a door but this protruding bolt is not suited in another position of the door. One such situation is shown in FIG. 13, where the protruding bolt is used to lock the door in its closed position, whereas a bolt 26" is more suited to keep the door in its open position by engagement with a fixed retaining member 55.

The bolt 54 is connected to the block 31" by means of matching ribs 56*a*, 56*b* and grooves 57*a*, 57*b* integrally formed on the bolt and in the block 33", respectively. Thus, the bolt is slidably guided in relation to the block 31" in the direction of movement of the block. The bolt 54 is formed with a channel 58 having opposed walls 59*a*, 59*b*. A screw 60 having a head 61 located in operation within opposed slots 62*a*, 62*b* formed in the walls 59*a*, 59*b* is threaded into a hole 63 formed in a post 64 integral with the block 31" (visible only in the lower block 33"). By screwing the screw 60 in either direction, the extension of the bolt 54 in relation to the block 31" may be adjusted at need.

The second embodiment of the lock is shown to be adapted to varying door leave thickness, particularly thicker door leaves. Firstly, there is provided a door leaf thickness adapter 65. As shown in FIG. 9, this adapter is a structure having a closed wall 66 shaped in conformity with the equally shaped, exterior surfaces of the walls 67 of the handle openings 29", 30". Thus, when assembling the lock, the sleeve-like adapter will enclose the walls 66 and—depending on the actual door leaf thickness—be more or less telescopingly slid onto the walls 67 of both handle blocks. It has proven sufficient to positively attach the adapter to but one of the blocks, here block 31", by means of screws 68 extending through ears 69 provided on the exterior of the adapter and screwed more or less into diametrically opposed posts 70 integral with the blocks. This attachment is mainly to prevent the adapter from tilting. Being thus kept in a steady upright position, movement of one of the handle blocks will be transferred to the other block by the adapter 65.

To prevent view through the lock, i.e., its aligned handle member openings, a partition or dividing wall is normally mounted between the two blocks 31, 33. Such dividing wall may be integral with one of the blocks, or, may be a separate structure inserted between them. Anyhow, when a relatively thin door is concerned, the free space to grip a handle member to operate the door may be limited by a fixed wall to an extent that makes operation uncomfortable. The present invention provides a solution to that problem by making the dividing wall swingable a limited angle to either sides of a central plane between the blocks 31, 33. An example of such a swingable dividing wall 71 is shown in FIG. 9.

Although this example concerns a dividing wall provided in the adapter 65, it is realized that it may as well be provided between the handle openings 29', 30' of the first embodiment.

The dividing wall 71 is shown to be integrally molded with the wall 66 of the adapter 65, as particularly appears from the section of FIG. 10. A relatively thin hinge portion 72 connects the wall 66 to the dividing wall 71 to make the latter easily swingable when touched by fingers inserted into the handle of the lock to operate it. The dividing wall is provided with swing restricting projections 73 at its base connected to the wall 66 so as to restrict swinging movement of the dividing wall in positions still preventing view through the lock by abutment against the wall 66.

When inserting a hand, or, at least some fingers of a hand into a handle opening, the dividing wall will deflect and swing towards the opposite side of the lock, thereby providing essentially increased access space for operating the handle while still preventing view through the lock and the door.

In order also to adapt the lock casing to thicker door leaves, the casing and the fore-end and the lock according to the second embodiment is divided in two halves 22*a*, 22*b* and 24*a*, 24*b* as shown in FIGS. 9, 11, 12 and 13. Equally, the guide frame is divided in two parts 35*a*, 35*b*, guiding movement of the blocks 31" and 33", respectively. Furthermore, each of the blocks 31", 33" is urged by a separate spring 49*a*, 49*b* towards the locking positions of the bolt 26" and the chamfered bolt 54. The springs are engaged on respective trunnions 48*a*, 48*b* formed on the guide frames 35*a*, 35*b*, respectively, and extend into holes 74*a*, 74*b* formed in the respective block 31", 33".

Shown in FIGS. 9 and 11 are also screws 75 for the attachment of the lock casing halves to a door leaf, as well as rubber elastic buffers 76 to be partly introduced into corresponding holes 77 in the lock casing to prevent hard impact of the lock against encountered objects, such as portions of the wall 17 and the post 20 shown in FIG. 1.

Furthermore, FIGS. 9 and 11 show connectors 78 for connecting the casing parts 22*a*, 22*b* to a respective guide frame 35*a*, 35*b* by snapping into apertures 79 provided in the guide frames.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lock adapted to be mounted in a swinging door, said lock comprising a lock casing having a fore-end and at least a first side wall, a first bolt being slidably movable within said casing between a locking position and an open position and being spring-loaded in a forward direction towards said locking position for engagement with a stationary engagement member, wherein said lock casing has an opening in its fore-end merging with an opening in said first side wall, and wherein said first bolt does not extend beyond said fore-end in said locking position, said opening in said first side wall enabling introduction therethrough of said engagement member upon being moved to the locking position to provide engagement between said stationary engagement member and said first bolt in said locking position thereof;

said first bolt being integral with a first handle member in a first unitary block slidably guided relative said first side wall.

2. The lock according to claim 1, and further including a second side wall opposed to said first side wall, wherein a guide member is positioned between said first and second side walls, said guide member having parallel legs for guiding movement of said first bolt.

3. The lock according to claim 1, and further including a second handle member being integral with a second unitary block joined to said first unitary block to form a unitary handle and bolt member.

4. The lock according to claim 3, and further including a second side wall opposed to said first side wall, wherein said unitary handle and bolt member is slidably guided between said first and second side walls.

5. The lock according to claim 4, wherein a guide member is positioned between said first and second side walls, said guide member having parallel legs for guiding movement of said unitary handle and bolt member.

6. The lock according to claim 4, wherein a dividing wall is arranged between said first and second handle members, said dividing wall being hinged at one side so as to enable at least a limited deflection thereof upon manual operation of one of said first and second handle members.

7. The lock according to claim 1, and further including a second handle member being integral with a second unitary block carrying a second bolt member.

8. The lock according to claim 7, wherein said first unitary block and said second unitary block are separated but mutually connected by a door leaf thickness adapter transferring movement between said blocks.

9. The lock according to claim 8, wherein said thickness adapter is a sleeve-like structure telescopingly connected to both of said blocks.

10. The lock according to claim 9, wherein a dividing wall is arranged within said sleeve-like structure, said dividing wall being hinged at one side so as to enable at least a limited deflection thereof upon manual operation of one of said first and second handle members.

11. A lock comprising:

a lock casing having a fore-end and at least a first side wall;

a first bolt being slidably movable within said casing between a locking position and an open position and being spring-loaded in a forward direction towards said locking position;

said lock casing includes an opening in its fore-end for merging with an opening in said first side wall;

said first bolt does not extend beyond said fore-end in said locking position and said opening in said first side wall enables introduction therethrough of an engagement member that projects into said lock casing upon the lock being moved to the locking position to provide engagement with said first bolt in said locking position thereof;

said first bolt being integral with a first handle member in a first unitary block slidably guided relative said first side wall.

12. The lock according to claim 11, and further including a second side wall opposed to said first side wall, wherein a guide member is positioned between said first and second side walls, said guide member having parallel legs for guiding movement of said first bolt.

13. The lock according to claim 11, and further including a second handle member being integral with a second unitary block joined to said first unitary block to form a unitary handle and bolt member.

14. The lock according to claim 13, and further including a second side wall opposed to said first side wall, wherein said unitary handle and bolt member is slidably guided between said first and second side walls.

15. The lock according to claim 14, wherein a guide member is positioned between said first and second side walls, said guide member having parallel legs for guiding movement of said unitary handle and bolt member.

16. The lock according to claim 13, wherein a dividing wall is arranged between said first and second handle members, said dividing wall being hinged at one side so as to enable at least a limited deflection thereof upon manual operation of one of said first and second handle members.

17. The lock according to claim 11, and further including a second handle member being intergral with a second unitary block carrying a second bolt member.

18. The lock according to claim 17, wherein said first unitary block and said second unitary block are separated but mutually connected by a door leaf thickness adapter transferring movement between said blocks.

19. The lock according to claim 18, wherein said thickness adapter is a sleeve-like structure telescopingly connected to both of said blocks.

20. The lock according to claim 19, wherein a dividing wall is arranged within said sleeve-like structure, said dividing wall being hinged at one side so as to enable at least a limited deflection thereof upon manual operation of one of said first and second handle members.

* * * * *